US006146709A

United States Patent [19]

Katz et al.

[11] Patent Number: 6,146,709

[45] Date of Patent: Nov. 14, 2000

[54] METHOD FOR APPLICATION OF PROTECTIVE POLYMER COATING

[75] Inventors: Joseph M. Katz, Buffalo Grove; William F. Rush, Jr., Tinley Park; Victor Tamosaitis, Mokena, all of Ill.

[73] Assignee: Institute of Gas Technolgy, Des Plaines, Ill.

[21] Appl. No.: 09/232,492

[22] Filed: Jan. 15, 1999

Related U.S. Application Data

[60] Provisional application No. 60/092,899, Jul. 15, 1998.

[51] Int. Cl.[7] ..... B05D 1/08; B05D 1/38; B05D 3/02

[52] U.S. Cl. ..... 427/447; 427/195; 427/203; 427/314; 427/407.1

[58] Field of Search ..... 427/446, 447, 427/202, 203, 230, 239, 407.1, 408, 409, 314, 316, 318, 374.4, 379, 195; 428/416, 418, 511, 451

[56] References Cited

U.S. PATENT DOCUMENTS

| | | |
|---|---|---|
| 2,716,075 | 8/1955 | Wiese . |
| 3,914,468 | 10/1975 | Condon et al. . |
| 3,988,288 | 10/1976 | Yamauchi et al. . |
| 4,268,542 | 5/1981 | Sakakibara et al. . |
| 4,276,390 | 6/1981 | Nakabayashi et al. . |
| 4,345,004 | 8/1982 | Miyata et al. . |
| 4,510,007 | 4/1985 | Stucke . |
| 4,962,137 | 10/1990 | McKinney et al. . |
| 4,971,838 | 11/1990 | Hamamura et al. . |
| 4,985,278 | 1/1991 | George . |
| 4,999,221 | 3/1991 | Eigenbrod et al. . |
| 5,041,713 | 8/1991 | Weidman . |
| 5,178,902 | 1/1993 | Wong et al. . |
| 5,211,990 | 5/1993 | McKinney et al. . |
| 5,792,518 | 8/1998 | Gibson et al. . |

FOREIGN PATENT DOCUMENTS

| | | |
|---|---|---|
| 407753 | 11/1973 | Russian Federation . |

*Primary Examiner*—Frederick Parker
*Attorney, Agent, or Firm*—Pauley Petersen Kinne & Fejer

[57] ABSTRACT

A process for application of a protective coating to a steel, concrete, or wooden structure so as to provide protection against corrosion, weathering, or other environmental damage in which the surface to be protected is heated to a temperature in a range of about 75° F. to about 150° F. after which a liquid thermoset primer is applied to the heated material in two stages. The first portion is solidified by heating and then coated with a second portion, forming an uncured liquid thermoset outer primer layer. A melted polymer powder layer is then applied by flamespraying over the uncured liquid thermoset primer layer, forming an intermediate polymer powder layer embedded in the uncured liquid thermoset primer layer. The intermediate melted polymer powder layer is then heated to a flow temperature of the polymer powder and a second layer of melted polymer powder is applied over the intermediate polymer powder layer, forming an outer melted polymer powder layer which then cools to form the final protective coating.

6 Claims, No Drawings

METHOD FOR APPLICATION OF PROTECTIVE POLYMER COATING

CROSS REFERENCE TO RELATED APPLICATION

This application claims the benefit of U.S. Provisional Application No. 60/092,899, filed Jul. 15 1998.

BACKGROUND OF THE INVENTION

1. Field of the Invention

This invention relates to a method for applying polymer coatings to large substrate materials including steel, concrete, or wooden structures for protection against corrosion, weathering or other environmental damage. Included within the structures to which the method of this invention may be applied are buried steel pipelines used, for example, in the transmission and distribution of natural gas and oil. The method of this invention is particularly suitable for "in-the-field" applications and applications where maintaining the temperature of the substrate material to which the coatings are applied below a level at which the integrity of the substrate material is affected or at which a potentially hazardous condition is created is essential.

2. Description of Prior Art

Protective coatings are extensively used to protect metallic substrates, such as steel pipes and pipelines, from corrosion and mechanical damage. Widely used commercially available coatings for such substrates include fusion bonded epoxy (FBE) coatings. In the United States, FBE coatings are especially popular for pipeline protection because of their excellent anticorrosion properties, good adhesion to metal surfaces, and resistance to cathodic disbondment from the metallic substrate. However, when used alone, FBE coatings are prone to handling damage during pipe installation and also exhibit relatively high moisture permeation. Thus, most of the FBE coatings currently applied, especially in Europe, are an integral part of three-layer systems consisting of an epoxy (mainly FBE) primer, a plastic copolymer adhesive, and a plastic (polyolefin) outer sheath for protection of the epoxy primer. The basic principle in the three-layer systems is the use of an adhesive middle layer to provide the bonding agent between the epoxy primer and the plastic (polyolefin) outer layer. Polyolefins are preferred for use as a protective layer because they have many of the qualities lacking in isolated fusion bonded epoxy coatings, such as superior impact resistance, as well as improved impermeability to moisture and many chemicals. Polyolefins are also easy to fabricate for plant-applied coatings. However, because of their nonpolarity, polyolefins bond poorly with metallic substrates. Even the use of adhesives, such as copolymers, in bonding the polyolefin to the metallic substrate has not been found to provide a coating with equal properties to the epoxy/metal bond in terms of resistance to hot water immersion and cathodic disbandment. Another disadvantage of these systems, particularly when used in "in-the-field" applications on steel pipelines, is the time consuming preheat up to 450° F. and the number of different materials and application means required for applying the coating layer. In "in-the-field" applications, it is highly desirable to minimize the amount of equipment and number of different materials to be applied.

Other coating systems known to afford protection against both corrosion and chemical attack include fluoroplastic coatings that afford excellent protection against chemicals and are not attacked by either strong acids or solvents. In addition to their well-known mechanical properties, such as high resistance to abrasion and good elasticity, the thermal properties of the fluoroplastics also allow them to be used just as they are, even when prolonged exposure to temperatures up to 260° C. is involved. However, like other plastics, fluoroplastics exhibit both poor adhesion to steel surfaces and permeability to gases, liquids and solutions, thereby necessitating the application of relatively thick layers.

A process for powder coating high temperature resistant surfaces with multilayer coatings of fluoroplastics is taught by U.S. Pat. No. 4,999,221.

U.S. Pat. No. 4,510,007 teaches a method for jacketing steel pipes in which the pipe is heated to a temperature sufficiently to cause a subsequently applied epoxy resin-curing agent powder blend to melt after which a twin-foil of hose-like tubular configuration is extruded upon the pre-coated object under the proviso that the ethylene copolymer portion of the twin- or double-ply hose has been predried, and under the further assumption that the extrusion temperature particularly of the outer thermoplastic hose is in the range of about 165° C. to 190° C. Implementation of this method requires preheating the steel pipes to a temperature between about 175° C. and 275° C. in order to ensure melting of the powdered epoxy resin-curing agent powder blend. One problem with this method is that temperatures in the required range are difficult, if not impossible, to achieve on, for example, in situ underground pipelines. In addition, these temperatures are high enough that the integrity of any internal surface treatment, for example, internal pipeliners, could be compromised. U.S. Pat. No. 4,345,004 teaches a process for forming an olefinic resin film on a metal substrate comprising forming a multi-layer coated film consisting of an olefinic resin film as a surface layer portion and a cured epoxy resin film as an underlayer portion on a metallic substrate by a single coating operation using a multi-layer film-forming coating composition comprising as main resinous components a solid powder containing an olefinic resin having a melt index of 0.3 to 80 grams per 10 minutes, a solid powder containing a polar group-containing modified olefinic resin having a melt index of 0.3 to 80 grams per 10 minutes, and a film-forming resinous material comprising an epoxy resin having a number average molecular weight of about 350 to 4,000 and an epoxy equivalent of 150 to 3,800 and a curing agent therefor, and then heat-bonding an olefinic resin lining material to the olefinic resin surface layer of the multi-layer coated film.

See also U.S. Pat. No. 5,178,902 which teaches a method for applying and forming a protective composite coating on a metallic substrate in which the substrate is heated to a temperature between about 175° C. and 275° C. and a powdered coating of epoxy resin between 100 and 400 microns thick is applied to the outer surface of the heated substrate. A premixed powder coating of epoxy resin and polyolefin is applied directly onto the epoxy resin coating, forming an interlayer of interspersed domains of epoxy and polyolefin between about 100 and 400 microns in thickness. Onto this, powdered polyolefin is sprayed to produce a polyolefin sheath coating for the metallic substrate between 200 and 1,000 microns in thickness. In accordance with one embodiment, the interlayer is formed by spraying pure epoxy resin powder and polyolefin powder from separate sources simultaneously onto the substrate.

Application of a coating to a metallic substrate preheated to a temperature between about 160° F. and about 240° F. is frequently carried out by flame spraying in which a stream of pneumatically conveyed finely divided thermoplastic material is propelled through a flame and onto the substrate surface to be coated. The thermoplastic material becomes molten from the heat of the flame and is deposited onto the substrate surface where it cools and hardens to form a protective coating. Flame spray guns and processes employing flame spraying are well known in the art. See, for example, U.S. Pat. No. 5,211,990; U.S. Pat. No. 4,962,137; U.S. Pat. No. 5,041,713; U.S. Pat. No. 3,988,288; U.S. Pat. No. 4,985,278; and U.S. Pat. No. 4,276,390.

Russian Patent 407753 teaches a method for producing polymer coatings from powder thermoplastic materials in which a thermoset heat-resistant resin-based liquid primer is applied to a substrate and a thin layer of heated thermoplastic polymer powder is sprayed on the non-hardened sticky primer. After the primer has hardened at room temperature, the surface layer of the coating is heat treated, and additional layers of fused thermoplastic material are applied. A similar method for repair of pipelines is taught by U.S. Pat. No. 5,792,518. One problem associated with the methods taught by both of these patents arises from the requirement that the thin layer of thermoplastic polymer powder be applied to the primer layer before it has had an opportunity to harden. During the application of the thermoplastic polymer powder, it is not uncommon for the non-hardened primer surface to be breached by the pressurized spray resulting in the formation of air pockets within the primer which significantly reduce the overall strength and integrity of the primer layer. Another problem associated with the methods taught by these patents is the requirement that the thermoset heat resistant, resin-based primer harden at ambient temperature before the surface layer of the polymer powder coating can be applied, thereby rendering it unattractive for in-the-field use where it is undesirable to have workers unproductively waiting for the hardening to occur, which, at lower ambient temperatures, could be for extended periods of time. Still a further problem associated with the methods taught by these patents relates to the requirement that the thermoset heat-resistant, resin-based primer be applied at ambient temperatures as opposed to elevated temperatures. The flowability of the primer is substantially retarded at ambient temperatures rendering it difficult to apply evenly.

Yet another problem associated with conventional methods for coating steel, concrete, or wooden structures relates to the disposition of moisture between the structure and the coating. For example, underground pipelines, due to the temperature of the fluid flowing therethrough, generally "sweat" when exposed to ambient temperatures. Application of protective coatings by conventional means results in some water being trapped between the protective coating and the structure, thereby affecting in a negative way the integrity of the interface between the protective coating and the structure to be protected.

SUMMARY OF THE INVENTION

Accordingly, it is one object of this invention to provide a process for applying protective polymer coatings to steel, concrete, or wooden structures using as an initial layer a liquid thermoset primer, which method overcomes the flowability and long curing-time problems associated with application of the primer at ambient temperatures.

It is another object of this invention to provide a method for applying polymer coatings to steel, concrete, or wooden structures which avoids the use of solvent based paints, the solvents of which can negatively impact the integrity of the desired coating as a result of its volatilization during drying, and drastically shortens the time required to reach a finished state.

It is yet another object of this invention to provide a process for applying a protective coating to steel, concrete, or wooden structures which can be carried out in situ.

It is yet another object of this invention to provide a method for applying a protective coating to buried steel pipelines which are subsequently subjected to cathodic protection voltages.

These and other objects of this invention are achieved by a process for application of a protective coating to a substrate material in which a first portion of a liquid thermoset primer is applied to the substrate material and forced to cure almost completely. In accordance with a particularly preferred embodiment of this invention, the substrate material is heated to a temperature in a range of about 75° F. to about 150° F. Heating of the substrate material in this manner not only improves the flowability of the liquid thermoset layer, but also evaporates any condensation present on the substrate surface. Indeed, if the surface temperature of the substrate material is at or near the dew point of the surrounding air, heating of the substrate material is required to eliminate condensation. After substantial curing of the first portion of liquid thermoset primer, a second portion of liquid thermoset primer is applied to the substrate material over the partially cured liquid thermoset primer, forming an uncured thermoset primer layer. A molten polymer powder is then applied over the uncured liquid thermoset primer layer, forming an intermediate molten polymer powder layer partially embedded in the uncured liquid thermoset layer. The intermediate polymer powder layer is then heated to a flow temperature of the polymer powder and a second molten polymer powder layer is applied over the intermediate molten polymer powder layer, forming an outer melted polymer powder layer. In accordance with a particularly preferred embodiment of this invention, the intermediate molten polymer powder layer and the outer molten polymer powder layer are applied by flame spraying.

DESCRIPTION OF PREFERRED EMBODIMENTS

The method of this invention produces polymer coatings on steel, concrete, or wooden structures using powder thermoplastics, for example, polyolefin, and liquid thermoset primers, for example, epoxies. In accordance with a particularly preferred embodiment of the method of this invention, the substrate material to which the polymer coating is to be applied is cleaned and then heated to a temperature in the range of about 75° F. to about 150° F. after which a liquid thermoset primer is applied, using a brush, roller or other appropriate device. Liquid thermoset primers, such as those contemplated for use in the process of this invention, are typically cured at ambient temperature, although curing may be accelerated by heating the thermoset material. In accordance with one preferred embodiment of this invention, this first portion of liquid thermoset primer is held at a temperature between about 150° F. and about 250° F. until it begins to cure. Curing of the thermoset material results in thickening and, ultimately, hardening of the thermoset material. As the material thickens, its flowability becomes virtually nonexistent. This condition is readily recognized because an object brought into contact with the thermoset material will not stick to it.

After substantial curing of the first portion of liquid thermoset primer, a second portion of liquid thermoset primer is applied to the substrate material over the cured liquid thermoset primer, resulting in a total thermoset primer layer thickness in the range of about 2 to about 40 mils. This second portion of liquid thermoset primer layer, while still in an uncured relatively liquid state, is immediately coated with a thin layer of a partially melted thermoplastic powder by flame spraying, producing a first molten polymer powder layer in the range of about 1 to 5 mils thick and embedded in the liquid primer. Before the liquid thermoset primer has had time to cure, the first thermoplastic powder layer is heated to a flow temperature of the powder, typically in the range of about 250° F. to about 450° F., and an additional layer of the molten thermoplastic powder is applied over the first thermoplastic powder layer by means of flame spraying, producing an outer layer having a thickness in the range of about 10 to about 80 mils.

As previously indicated, good bonding between the thermoset primer and the partially melted thermoplastic powder requires that the top portion of the thermoset primer be in a substantially non-hardened, liquid form. However, application of the partially melted thermoplastic powder to a thin non-hardened, liquid thermoset primer layer causes the particles, as well as some of the driving gas stream that entrains the molten powder, for example in the case of flame spraying, combustion products, to flow into the interior of the thin thermoset primer layer, resulting in the formation of bubbles therein and generally decreasing the structural integrity of the thermoset primer layer. Consequently, in order to ensure the structural integrity of the thermoset primer layer proximate the surface of the substrate and at the same time ensure good bonding of the thermoplastic powder layer to the thermoset primer layer, it is essential that the liquid thermoset primer layer be applied to the substrate material in two stages as discussed hereinabove. That is, the first portion of the liquid thermoset primer must be so well cured that the driving gas stream that entrains the particles will not penetrate the first layer of thermoset primer, but will embed the molten powder in the second layer of thermoset primer.

Accordingly, the distinctive features of the preferred embodiment of the method of this invention are the preheating of the substrate material to which the coating is to be applied which produces a more uniform and continuous thermoset primer layer adjacent to the surface of the substrate material, application of the liquid thermoset primer layer in two stages, and the immediate application of a thin layer of a partially melted thermoplastic powder to the uncured surface of the second portion of thermoset primer layer which serves as a transition zone between the thermoset primer layer and the subsequently applied outer layer of molten powder. Immediate application of the intermediate layer of thermoplastic powder enhances bonding of the powder layer to the thermoset primer layer.

Suitable liquid thermoset primers for use in the process of this invention comprise liquid resins selected from the group consisting of epoxy resins, urethane resins, and mixtures thereof, and curing agents, the resin and curing agent being mixed in a ratio of about 1 to 1 to a ratio of about 5 to 1 by weight, respectively. In order to avoid bubbling of the primer layer during curing and plastic flamecoat application, suitable liquid thermoset primers for use in the process of this invention contain no solvents. By the term "solvent," we mean any material which would evaporate upon curing and flamespraying, giving rise to the formation of bubbles within the primer layer. Suitable overcoat materials for overcoating the uncured portion of the thermoset primer layer include polyethylene or polypropylene based thermoplastic powders.

The key to making a strong adherent bond between the liquid thermoset primer layer and the thermoplastic layers is the application of the partially melted transition powder layer to the portion of uncured liquid thermoset epoxy resin that is applied over the first portion. This can only be accomplished by using a flame spraying technique. Application of cold thermoplastic powder to an uncured liquid thermoset primer layer, without benefit of partial melting in a flame spraying gun and subsequent embedding of the molten powder in the uncured liquid thermoset primer layer, does not result in a good bond between the layers.

EXAMPLE

This example is directed to application of the method of this invention to an in-service natural gas pipeline. To ensure good adherence of the coating layers to the pipe, the pipe surface is cleaned, preferably by blasting, to a 3 mil profile. Five (5) parts Hempel 436US epoxy and one (1) part Hempel 981US curing agent (both available from Hempel Coatings, Inc. of Houston, Tex.) are mixed for three minutes, forming a suitable liquid thermoset primer. Approximately, one ounce of the primer per 100 square inches of surface to be coated, to reach a thickness of about 8 mils, is required. The portion of pipe to be coated is heated to a temperature between about 100° F. and 110° F. and maintained at this temperature for about 2 minutes. After the two minute heat maintenance period, the first portion of liquid thermoset primer layer is applied to the heated pipe surface. While the liquid thermoset primer is being applied, it is important that the temperature of the uncoated portions of the pipe surface yet to be coated be maintained at the elevated temperature. After application of the first portion of liquid thermoset primer is completed, the temperature of the surface is raised gradually to a temperature of about 200° F. and held at said temperature for about four minutes. The temperature is then raised to about 250° F. and held at said temperature for about three minutes. At this point, the first portion of liquid thermoset primer should be solidifying. The surface temperature is allowed to cool to 110° F. and a second portion of liquid thermoset primer is applied. Immediately after application of the second portion of liquid thermoset primer, while the top portion is still in an uncured, liquid state, a thin layer of partially melted thermoplastic powder is flame sprayed over the uncured portion of thermoset primer. The temperature of the coating system is raised, as necessary, to about 150° F. and maintained at said temperature for about three minutes. Thereafter, the temperature of the system is raised to the melting point of the polymer powder (about 300° F. to about 450° F. depending upon the powder material being applied) at which temperature an additional thickness of melted thermoplastic powder is flamesprayed over the first thermoplastic powder layer.

Polymer powders which we have found to be suitable for use in the process of this invention are GUARDIAN XLS, ET-15 and ET-20 available from PFS, Inc. and Eutectic Company.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for application of a protective coating to a substrate material comprising the consecutive steps of:

applying a first portion of a solvent-free liquid thermoset primer to a preheated substrate material wherein said substrate material has been preheated to produce a uniform and continuous primer layer;

curing and solidifying said applied first portion of said liquid thermoset primer;

applying a second portion of said liquid thermoset primer to said substrate material on said cured and solidified liquid thermoset primer to form an uncured liquid thermoset primer layer;

applying a melted thermoplastic polymer powder by flame spraying to said uncured liquid thermoset primer layer to form an intermediate polymer powder layer embedded in said uncured liquid thermoset primer layer;

heating said intermediate polymer powder layer to a flow temperature of said thermoplastic polymer powder;

applying a second layer of said melted thermoplastic polymer powder by flame spraying onto said intermediate polymer powder layer to form an outer melted polymer powder layer; and cooling said outer melted polymer powder layer to form a final coating layer.

2. A process in accordance with claim 1, wherein said substrate is heated to a temperature in a range of about 75° F. to about 150° F. prior to application of said liquid thermoset primer.

3. A process in accordance with claim 1, wherein said substrate material is selected from the group consisting of metal, concrete, and wood.

4. A process in accordance with claim 1, wherein said liquid thermoset primer layer has a thickness in a range of about 2 to about 40 mils.

5. A process in accordance with claim 1, wherein said intermediate polymer powder layer has a thickness in a range of about 1 to about 5 mils.

6. A process in accordance with claim 1, wherein said outer melted polymer powder layer has a thickness in a range of about 10 to about 80 mils.

* * * * *